United States Patent [19]

Saito

[11] Patent Number: 4,782,739

[45] Date of Patent: Nov. 8, 1988

[54] WOBBLE PLATE TYPE COMPRESSOR WITH ROTATION-PREVENTING MECHANISM

[75] Inventor: Yoshiyuki Saito, Honjo, Japan

[73] Assignee: Sanden Corporation, Gunma, Japan

[21] Appl. No.: 74,145

[22] Filed: Jul. 16, 1987

[30] Foreign Application Priority Data

Jul. 16, 1986 [JP] Japan ..... 61-107984[U]

[51] Int. Cl.[4] ..... F01B 3/02; F04B 27/08

[52] U.S. Cl. ..... 92/71; 417/269; 74/60

[58] Field of Search ..... 417/269; 74/60; 92/71; 91/507

[56] References Cited

U.S. PATENT DOCUMENTS

| | | | |
|---|---|---|---|
| Re. 27,844 | 12/1973 | Olson, Jr. | 417/269 |
| 1,781,130 | 11/1930 | Shaff | 74/60 |
| 2,398,486 | 4/1946 | Woods | 74/60 |
| 2,569,559 | 10/1951 | Devillers | 74/60 |
| 3,007,462 | 11/1961 | Balzer | 74/60 X |
| 3,151,527 | 10/1964 | Hamlin | 91/507 |
| 3,552,886 | 1/1971 | Olson, Jr. | 417/269 |
| 3,712,759 | 1/1973 | Olson, Jr. | 417/269 |
| 3,838,942 | 10/1974 | Pokorny | 417/269 |
| 3,945,765 | 3/1976 | Toyoda et al. | 417/269 |
| 4,005,948 | 2/1977 | Hiraga et al. | 417/269 |
| 4,095,921 | 6/1978 | Hiraga et al. | 417/269 |
| 4,236,878 | 12/1980 | Terauchi | 417/269 |
| 4,301,716 | 11/1981 | Saegusa et al. | 92/71 |
| 4,444,549 | 4/1984 | Takahashi et al. | 417/269 |
| 4,594,055 | 6/1986 | Hatakeyama et al. | 417/269 |
| 4,693,674 | 9/1987 | Fukai et al. | 417/269 |
| 4,697,992 | 10/1987 | Hatakeyama et al. | 417/269 |

*Primary Examiner*—Paul F. Neils

*Attorney, Agent, or Firm*—Banner, Birch, McKie & Beckett

[57] ABSTRACT

An improved wobble plate type refrigerant compressor in which the tendency of the wobble plate to rotate is reduced. The wobble plate is prevented from rotating and is allowed to nutate by a rotation-preventing mechanism which includes a pair of bevel gears which are coupled together. One bevel gear is located within the wobble plate and the other bevel gear is supported on the cylinder block. A steel ball is located between the bevel gears. The improvement is achieved by locating the bevel gear within the wobble plate so that the connecting rods are inclined to the axis of the cylinders. This arrangement is achieved by locating the bevel gear so that a line connecting the center of the bevel gear and including a point on the edge of the bevel gear located exactly between two teeth of the bevel gear includes a third point near the edge of the wobble plate which is located between receiving portions of the wobble plate but which is not located at the center between the two receiving portions. Rather, this point is shifted within a range of 5° in the rotational direction along the edge of the wobble plate from the centrally located point. The resulting construction reduces the rotational force created at the point of connection of the two bevel gears and thus increases the durability of the rotation-preventing mechanism and reduces vibration and noise.

3 Claims, 5 Drawing Sheets

WOBBLE PLATE TYPE COMPRESSOR WITH ROTATION-PREVENTING MECHANISM

BACKGROUND OF THE INVENTION

Field of Invention

The invention relates to a wobble plate type compressor especially for use in automotive air-conditioning systems, and more particularly, to a rotation-preventing mechanism for a wobble plate type compressor.

Description of the Prior Art

Wobble plate type compressors are well known in the art as disclosed, for example, in U.S. Pat. No. Re. 27,844. In the prior art, rotation of the drive shaft is converted into reciprocating motion of the pistons through a cam rotor having a sloping surface mounted on an end of the drive shaft and a wobble plate disposed on the sloping surface through a needle bearing therebetween. The wobble plate is supported on a fixed member in a manner that prevents it from rotating but allows it to nutate, or wobble. Thus, the wobble plate wobbles by the rotation of the cam rotor, and the piston rods connected to the wobble plate are reciprocated to compress fluid within the cylinders.

Referring to FIG. 1, which is a cross sectional view of a conventional wobble plate type compressor, the general structure of wobble plate type compressors will be explained. Compressor housing 1 is defined by crank chamber 11 and cylinder block 12 which is provided with a plurality of cylinders 121 axially disposed near the circumference of the cylinder block. One open end portion of housing 1 is covered by front end plate 2. Cylinder head 3 is mounted on the end surface of cylinder block 12 through valve plate 4 and affixed thereon by bolts 30.

Cylinder cavity 122 is formed at the center of cylinder block 12. Axial support device 5, which includes annular rod portion 51 with hollow portion 51*a* for disposing a coil spring (not shown) and bevel gear 52 formed on one terminal end of rod portion 51, is placed within cylindrical cavity 122. Key 123 is located in a groove defined on rod portion 51 of axial support device 5 and cylinder block 12 to prevent axial support device 5 from rotating. The center portion of bevel gear 52 is formed with seat portion 53.

Drive shaft 6 is rotatably supported in front end plate 2 through bearing 7 and is coupled at its inner end with cam rotor 8. Rotor 8 and the inner end of drive shaft 6 are disposed in crank chamber 11. Rotor 8 is axially and rotatably supported on the inner surface of front end plate 2 through bearing 9. Inclined surface 81 of rotor 8 is placed in close proximity to one end surface 101 of wobble plate 10 and is engaged with the wobble plate 10 by a bearing 13 located between cam rotor 8 and wobble plate 10. Bevel gear 14 is fitted on the central portion of wobble plate 10 by caulking and is provided with receiving seat 141 at its center. Bevel gear 14 interfits with bevel gear 52 through steel ball 15 to prevent the rotation of wobble plate 10. Accordingly, wobble plate 10 wobbles without rotation in response to the rotation of cam rotor 8.

A plurality of pistons 16 are reciprocally fitted within cylinders 121 and are connected to wobble plate 10 through connecting rods 17. As wobble plate 10 wobbles, pistons 16 reciprocate in cylinders 121.

Cylinder head 3 is defined by suction chamber 31 and discharge chamber 32. Discharge chamber 32 is located at the center of cylinder head 3 and suction chamber 31 surrounds discharge chamber 32. Inlet port 311 is formed on the outer end surface of cylinder head 3 for introducing refrigerant from a refrigerant circuit, and outlet port 321 is formed on the outer end surface of cylinder head 3 for discharging compressed refrigerant gas into the refrigerant circuit.

With reference to FIG. 2, a front view of wobble plate 10 with bevel gear 14 is shown. A plurality of receiving portions 102 for receiving one end of connecting rods 17 are spaced at regular intervals along the edge of wobble plate 10. Bevel geare 14 is fixed in the inner surface of wobble plate 10 by caulking portions 103. Wobble plate 10 is located with respect to bevel gear 14 so that point M, which is located at a center position between two teeth of bevel gear 14, is on a line drawn between the center point C of bevel gear 14 and a point P which is located at the center between two receiving portions 102. When wobble plate 10 and bevel gear 14 are combined with each other as described above, the center line of each connecting rod 17 is parallel to the center line of each cylinder 121, as shown in FIG. 3.

When the compressor is operated by rotating drive shaft 6, the axial force $P_1$ of pistons 16 is in a direction parallel to cylinders 121 as shown by the arrow and dotted line in FIG. 4. The drag force on inclined surface 81 of cam rotor 8 is in the direction shown by the arrow and dotted line $F_1$. Thus, a rotational force, as shown by dotted line and arrow $F_2$, is created at the contact point between bevel gears 14 and 52 and tends to create an undesirable rotation in the wobble plate 10. This force $F_2$ may be large enough to cause the rotation preventing mechanism provided in part by bevel gears 14 and 15 to break down and allow the wobble plate to rotate. At the very least, this force creates an undesirable level of vibration and noise at the bevel gears.

SUMMARY OF THE INVENTION

It is an object of this invention to provide a wobble plate type compressor in which durability of the rotation-preventing mechanism is improved.

It is another object of this invention to provide a wobble plate type compressor in which vibration and noise are eliminated.

These objects are accomplished by providing a refrigerant compressor which includes a compressor housing having a cylinder block further provided with a plurality of cylinders and a crank chamber adjacent the cylinder block. A reciprocative piston is slidably fitted within each of the cylinders. A drive shaft is supported on a front end plate which is mounted on one end portion of the compressor housing. A cam rotor is mounted on an inner end of the drive shaft. A wobble plate is disposed in close proximity with the inclined surface of the cam rotor and is provided with a centered first bevel gear which is further provided with a centered ball seat. A second bevel gear is supported on the cylinder block and also has a centered ball seat.

A ball is seated on both of the ball seats and supports the wobble plate so that the wobble plate is able to nutate about the center of the ball. Connecting rods connect the pistons to the wobble plate at receiving portions which are spaced at regular intervals along the edge of the wobble plate. The first bevel gear is located within the wobble plate so that the line made by the center point of the bevel gear and a point located at the center between two teeth of the bevel gear contains a point near the edge located between two receiving portions. This point is shifted within a range of 5° along the rotational direction from the point located at the center between two receiving portions.

Further objects, features and other aspects of this invention will be understood from the following detailed description of the preferred embodiments of this invention with reference to the drawing figures.

DESCRIPTION OF THE PREFERRED EMBODIMENT

Figure 1:
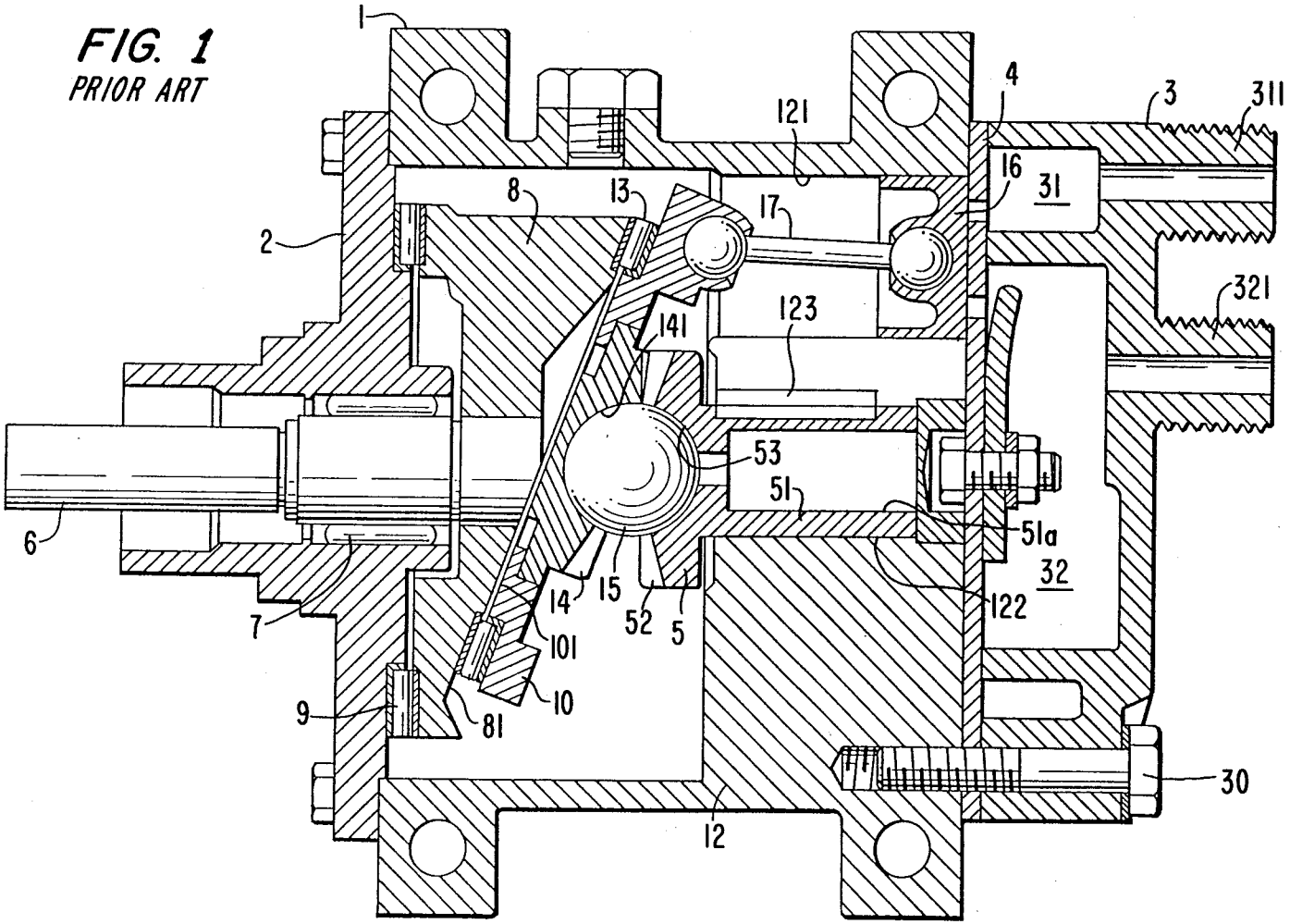
FIG. 1 PRIOR ART
FIG. 1 is a cross-sectional view of the conventional wobble plate type compressor.
Figure 2:
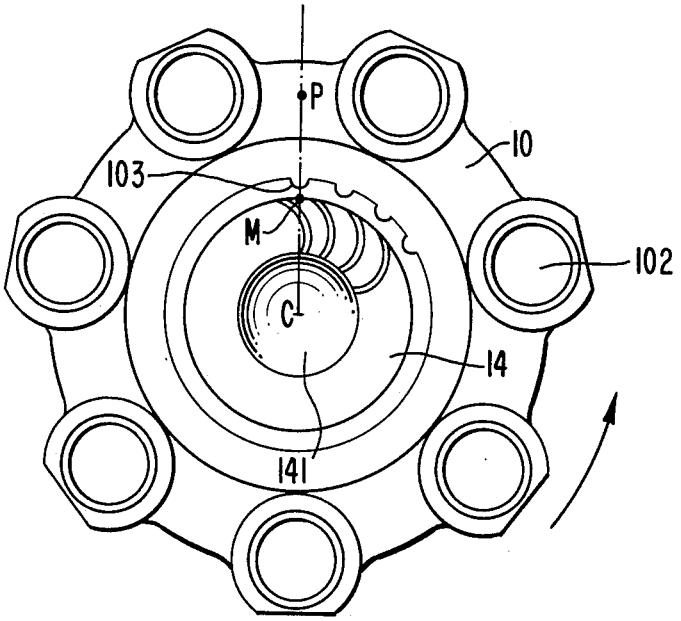
FIG. 2 PRIOR ART
FIG. 2 is a front view of a wobble plate with a bevel gear used in the wobble plate type compressor of FIG. 1.
Figure 3:
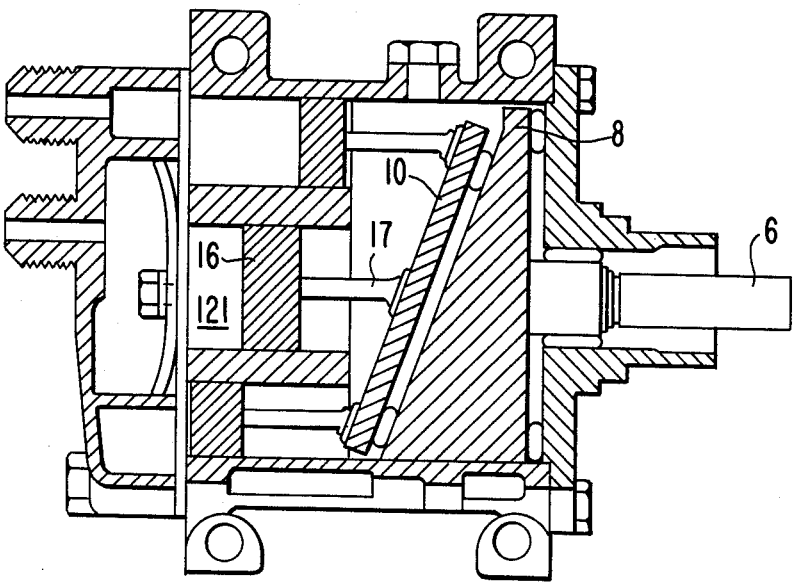
FIG. 3 PRIOR ART
FIG. 3 is a cross-sectional view of a conventional wobble plate type compressor illustrating the position of the connecting rods.
Figure 5:
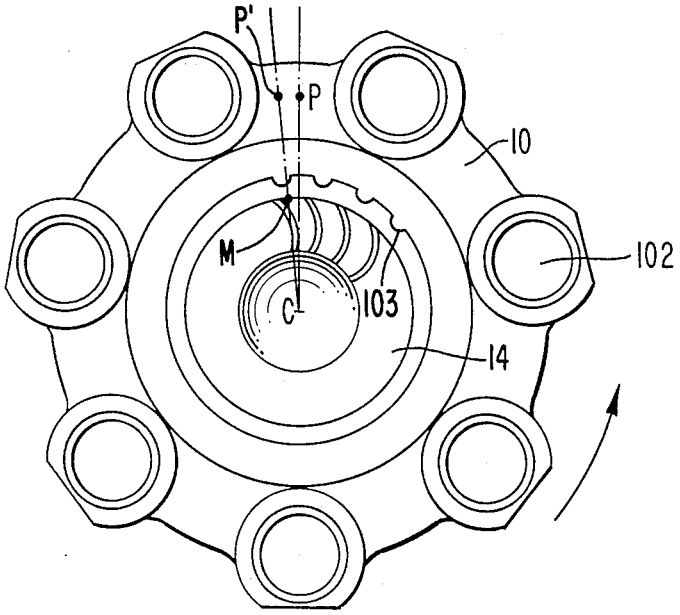
FIG. 5 is a front view of a wobble plate with a bevel gear used in a wobble plate type compressor in accordance with one embodiment of this invention.
Figure 6:
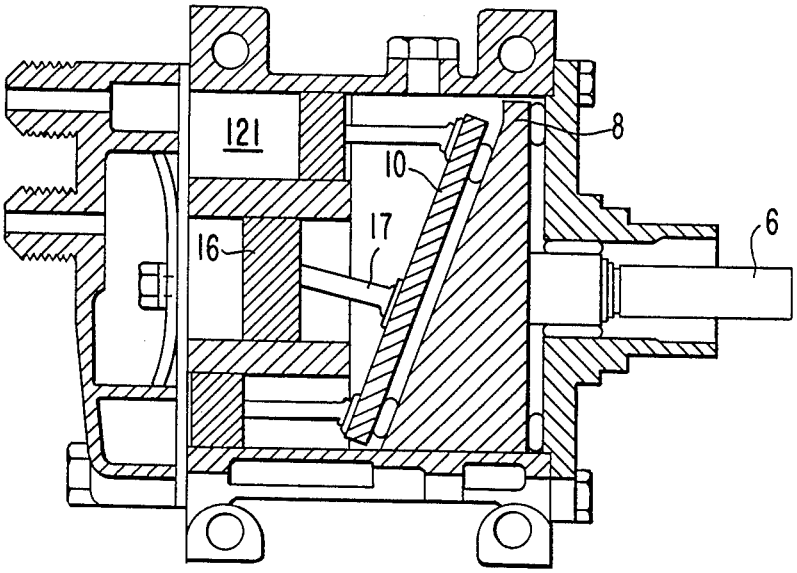
FIG. 6 is a cross-sectional view of a wobble plate type compressor in accordance with one embodiment of this invention illustrating the position of the connecting rods.

Referring to FIGS. 5 and 6, the connecting relationship between wobble plate 10 and bevel gear 14 in accordance with one embodiment of this invention is shown. The same reference numerals are used for elements of the present invention as used above to describe the prior art device in FIGS. 1–3.

Bevel gear 14 is fixed on the center portion of wobble plate 10 by caulking. Wobble plate 10 is located with respect to bevel gear 14 so that point M, which is a point located at the center between two teeth of bevel gear 14, is on a line which is drawn between center point C of bevel gear 14 and point P′ which is located between two receiving portions 102. Point P′ is shifted within a range of 5° in the rotational direction of the drive shaft from point P which is centrally located between two receiving portions. When the present arrangement of bevel gear 14 and wobble plate 10 is used, and bevel gear 14 is interfitted with bevel gear 52, connecting rods 17 are inclined in the rotational direction of drive shaft 6 as shown in FIG. 6.

Figure 4:
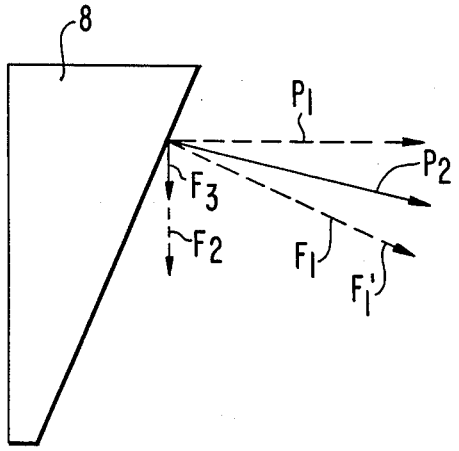
FIG. 4 is an explanatory view which shows the force relation of the rotation-preventing mechanism.

When the above compressor is operated due to rotation of drive shaft 6, pistons 16 are reciprocated. As a result, an axial force of piston 16 is created in the direction shown by the arrow and solid line $P_2$ in FIG. 4. It should be noted that drag $F_1'$ is not changed, that is, $F_1'$ equals $F_1$ even though the relationship between wobble plate 10 and bevel gear 14 is changed. Also, the direction of rotational force $F_3$ is the same as rotational force $F_2$ of the prior art even though the relationship between wobble plate 10 and bevel gear 14 is changed. However, since the direction of axial force $P_2$ of the piston is changed, the rotational force $F_3$ is reduced in magnitude as shown in FIG. 4. Therefore, the rotational force created at the contact point of bevel gears 14 and 52 of the rotational-preventing mechanism is reduced.

An increase in the inclination angle of the piston also creates an undesirable force on the inner surface of the cylinder wall. Thus, a range of 5° allows for the simultaneous reduction of the rotational force without unduly increasing the pressure on the cylinder wall. Preferably, the shift angle value is 2½°.

Figure 7:
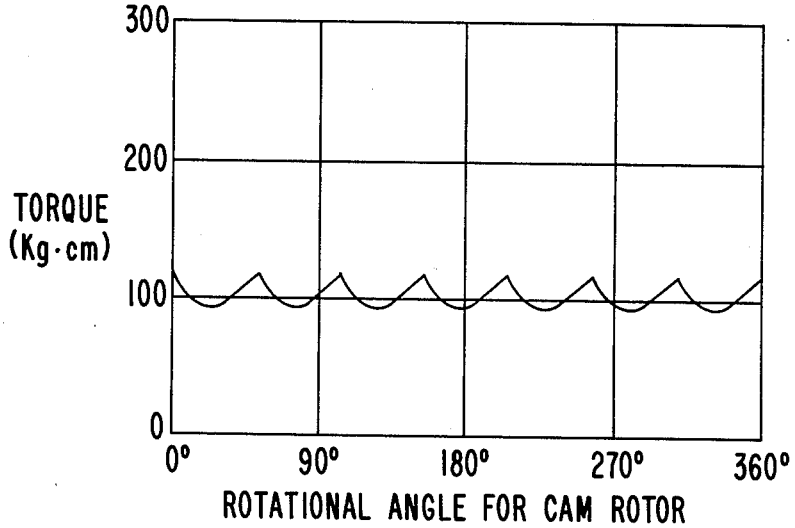
FIG. 7 PRIOR ART
FIG. 7 is a graph illustrating the relationship between the rotational angle of a cam rotor and the torque added to a conventional rotation-preventing mechanism.

With reference to FIG. 7, the relationship between the rotation angle of a cam rotor and the torque added to a conventional rotation-preventing mechanism is shown. The torque is maintained at about 100 kg/cm at any rotation angle of the cam rotor.

Figure 8:
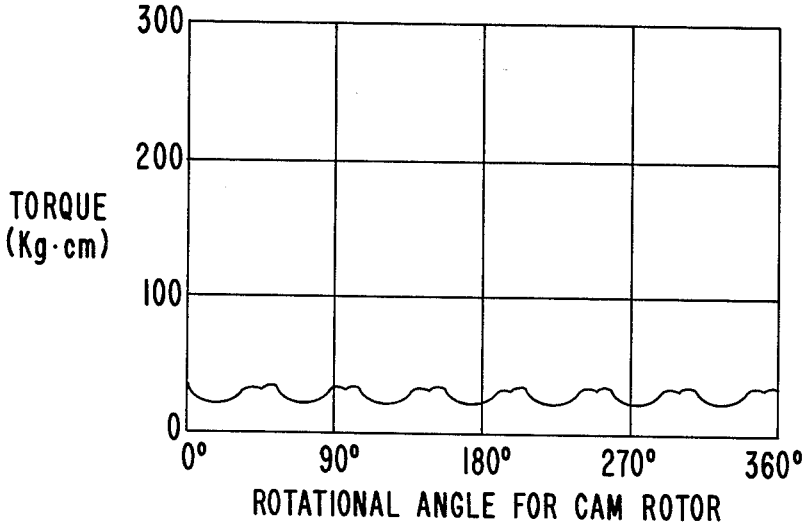
FIG. 8 is a graph illustrating the relationship between rotational angle of a cam rotor and torque added to a rotation-preventing mechanism in accordance with one embodiment of this invention.

With reference to FIG. 8, the relationship between the rotation angle of a cam rotor and the torque added to a rotation-preventing mechanism according to one embodiment of this invention is shown. The torque is maintained at about 35 kg/cm at any rotation angle of the cam rotor. Thus, due to the change in the connection between wobble plate 10 and bevel gear 14 provided by this invention, the torque added to bevel gears 14 and 52 is specifically reduced.

This invention has been described in detail in connection with the preferred embodiment. The preferred embodiment, however, merely is for example only and this invention is not restricted thereto. It will be easily understood by those skilled in the art that variations and modifications can be easily made within the scope of this invention, as defined by the appended claims.

What is claimed is:

1. In a refrigerant compressor including a compressor housing having a cylinder block provided with a plurality of cylinders and a crank chamber adjacent said cylinder block; reciprocative pistons slidably fitted within each of said cylinders; a drive shaft supported within a front end plate which is mounted on one end portion of said compressor housing; a cam rotor mounted on an inner end of said drive shaft and having an inclined end surface; a wobble plate disposed in proximity with said inclined end surface and having a centered first bevel gear; a second bevel gear supported on said cylinder block and coupled with said first bevel gear so as to nutatably support said wobble plate; and rods connecting respective pistons to said wobble plate; the improvement comprising:

said first bevel gear being permanently located with respect to said wobble plate so that said connecting rods are inclined relative to the axis of said cylinders to provide a torque transmitted to said wobble plate in a direction opposite to a rotational drag created in said wobble plate by said cam rotor.

2. The improvement as recited in claim 1 wherein said wobble plate has an edge along which are located receiving portions and said first bevel gear is located with respect to said wobble plate so that a line connecting the center point of said first bevel gear to a point located at the center between two teeth of said first bevel gear includes a point on said wobble plate between two said receiving portions which is shifted within a range of 5° in the rotational direction of said drive shaft from a central point between two said receiving portions.

3. The improvement as recited in claim 2 wherein said shift is 2½°.

* * * * *